US008381751B2

(12) United States Patent
Bartolotta

(10) Patent No.: US 8,381,751 B2
(45) Date of Patent: Feb. 26, 2013

(54) AUTOMATED DUMP STATION

(76) Inventor: Vito Ignatius Bartolotta, Bend, OR (US)

( * ) Notice: Subject to any disclaimer, the term of this patent is extended or adjusted under 35 U.S.C. 154(b) by 653 days.

(21) Appl. No.: 12/453,634

(22) Filed: May 18, 2009

(65) Prior Publication Data

US 2010/0288363 A1 Nov. 18, 2010

(51) Int. Cl.
*B65D 55/14* (2006.01)
*F16K 35/10* (2006.01)

(52) U.S. Cl. ..... 137/1; 137/383; 137/899; 220/262; 220/315; 70/158; 70/159

(58) Field of Classification Search ..... 137/383, 137/899, 363, 364, 371, 377, 1, 236.1; 141/326, 141/350, 382, 387–389; 220/210, 315, 262, 220/263, 264; 70/DIG. 41, 158–163, 166–169; 405/53–55; 251/295; 4/321, 323
See application file for complete search history.

(56) References Cited

U.S. PATENT DOCUMENTS 2,925,190 A * 2/1960 Littleton ..... 220/484
3,364,621 A * 1/1968 Erickson ..... 49/263
3,633,219 A * 1/1972 Byrd ..... 137/363
4,957,196 A * 9/1990 Shiojima et al. ..... 194/239
5,701,988 A * 12/1997 Tsukada ..... 194/241
5,947,156 A * 9/1999 Tomczyk ..... 137/899
6,081,186 A * 6/2000 Adams ..... 340/426.28
6,182,673 B1 * 2/2001 Kindermann et al. ..... 134/21

* cited by examiner

*Primary Examiner* — Stephen M Hepperle
*Assistant Examiner* — Kevin Murphy
(74) *Attorney, Agent, or Firm* — Hancock Hughey LLP

(57) ABSTRACT

A self service automated dump station is provided using a control mechanism for the collection of money that releases a latching mechanism located on a removable lockable cap that sits upon the dump station's drain line. In one embodiment provided, the removable lockable cap is lifted from the dump station inlet line by a remote foot pedal—this allows for a cleaner and more efficient means for inserting the hose from the waste tank of a vehicle into the dump station inlet line. Money payment can be either made by cash or by credit or debit cards. The operation of the dump station is made more efficient and requires fewer interactions between those who need to transfer waste from their vehicle waste tanks, such as operators of campers or recreational vehicles, and the dump station operator. Remote sensors can also be deployed to minimize the possibility of spillage or over-fill of the dump station if the dump station is not hooked up to a sewer system.

7 Claims, 4 Drawing Sheets

AUTOMATED DUMP STATION

CROSS REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

This invention relates to the use of an automated sanitary dump station. The primary users of this invention will be recreational vehicle (RV) users or operators who need to safely, effectively and efficiently dispose of sanitary waste collected in on-board RV sanitary tank or tanks. The present invention provides RV operators with a means for transferring the collected waste to a dump station at any time without the need for the dump station to be monitored by a clerk or attendant.

There are numerous types of recreational vehicles (RVs)—coming in all shapes and sizes. For the discussion of the present invention, the term recreational vehicle (RV) will include any type of motorized vehicle, camper, motor home, or trailer (an unpowered vehicle pulled by a powered vehicle) that has the facility to collect waste in an on-board sanitary tank. The collection of waste in on-board tanks has been part of the RV's history for decades. See U.S. Pat. No. 2,743,955 Housekeeping Structure, C. D. Willson, issued May 1, 1956. Most commercially made RVs have the facilities to collect waste in on-board sanitary tanks. Typically, sanitary tanks are located in RVs that have either a kitchen or bathroom or both. Sanitary tanks collect the waste and waste water generated in the on-board kitchen or bathroom.

After the waste is collected in the on-board sanitary tanks, the owner or operator will need to transfer the waste from the on-board tank to a proper sewer receptacle, by flushing (gravity drain), pumping or blowing the one or more sanitary tanks into either a waste tank or sewage connection. Currently, RV operators rely upon several means for disposing of the onboard waste. One method for disposing of the waste within the waste tank is to locate a dump station and transfer the waste from the on-board sanitary tanks to the dump station tanks or sewage system.

Dump stations are located throughout the world. In the United States there are over 2,000 dump stations according to the RVer's Guide to Dump Stations published in 2007 by Roundabout Publications. The Guide provides the location and direction to over 2,000 dump stations. These dump stations are primarily located at truck stops, travel centers, city and county parks, camping grounds, RV parks, gas stations, rest areas, and other locations. Currently, many of the dump stations are free to use with an ever increasing number of stations requiring a fee for use of the dump station.

The cost of operating a dump station has been going up and there are fewer and fewer free dump stations. The cost of the dump station is related to the cost of attending to the dump station (clerk or attendant) and the cost for disposing of any waste collected or disposed, for example; city sewer costs. It has been noted by the inventor that the number of dump stations appears to be decreasing and the number of free dump stations is fewer and fewer each year. The reduction in the number of dump stations and the increase of pay to use dump station increasing each year are due to the increase cost of disposing of the waste dumped at the dump station.

In the past, the location and operation of the dump stations were mutually beneficial with commercial operations located at the same place, with commercial operators benefitting from the business provided by the RV operator who needed to transfer waste at the dump station. As the cost of disposal or removal of the waste from RVs has increased, the cost for operating the dump station has become less lucrative to the associated commercial enterprise. In response to this escalation of costs and fees for operating a dump station, businesses that operate the dump station have started to impose fees or shut down the dump station.

It has been noted by the inventor that the collection of fees has been done by attendants or clerks who are operating the commercial enterprise associated with the dump station. RV operators make the payment to the attendant or clerk and then assist or allow the RV operator to dispose of the waste at the dump station. When the attendant or clerk is not available or the business associated with the dump station is not open, it is not uncommon for the dump station to be closed and locked—preventing the RV operator from disposing of the waste. This results in the RV operator either finding another dump station or waiting for the dump station to open. The commercial enterprise loses the opportunity to collect fees for the use of the dump station.

In addition to doing business up to 24 hours a day with an automated self service sanitary dump station, the commercial enterprise associated with the dump station does not have to employ an attendant or clerk to provide the oversight to run the dump station.

Many states and municipalities have codes and regulations for operating a dump station, including; Minnesota (MRC 4715), Ohio (OAC 3701-26-14), Illinois (Title 77 Chap. 1 Sec. 905.150) to name a few. One source of increased costs for operating a dump station is the additional regulations that are imposed by owners and operators of the dump stations.

The present invention provides the operator of a dump station with a means for collecting fees at any time while eliminating or minimizing the need for an attendant or clerk being present when the RV operator needs to use the dump station. A self serve automated dump station that allows the operator of the RV to transfer waste from the on-board waste tank(s) to the dump station is provided.

BRIEF SUMMARY OF THE INVENTION

A self service automated dump station is provided using a means to collect and register a payment with a signal generated once a payment has been generated that repositions a latch in a latching mechanism securing a locking cap that sits upon a dump station inlet line. When the latch is repositioned from a locked position to an unlocked position, the locking cap is removed from atop the drain line and exposing the drain line to allow the transfer of waste from an on-board waste tank to the drain line via a sanitary hose. The repositioning of the locking cap can be accomplished by means of hydraulic forces, electrical motors, or mechanical linkages. In one embodiment provided, the removable cap is lifted from the dump station inlet line by a remote foot actuator. Using the remote foot actuator provides for a cleaner and more efficient means for inserting the sanitary hose from the vehicles waste tank into the dump station inlet line. Money payment can be either made by cash or by credit or debit cards. The operation of the dump station is made more efficient and requires fewer interactions between the RV operator and the dump station operator. Remote sensors can also be deployed to minimize the possibility of spillage or over-fill of the dump station if the dump station is not hooked up to a sewer system.

DETAILED DESCRIPTION OF THE INVENTION

Various embodiments of the invention will now be described. The following descriptions provide specific details for a thorough understanding and enabling description of these embodiments. Additionally, some structures or functions may not be shown or described in detail, so as to avoid unnecessarily obscuring the relevant description of the various aspects and embodiments of the invention.

The terminology used in the description presented below is intended to be interpreted in its broadest reasonable manner, even though it is being used in conjunction with a detailed description of certain specific embodiments of the invention. Certain terms may even be emphasized herein; however, any terminology intended to be interpreted in any restricted manner will be overly and specifically defined as such in this Detailed Description section.

Figure 1:
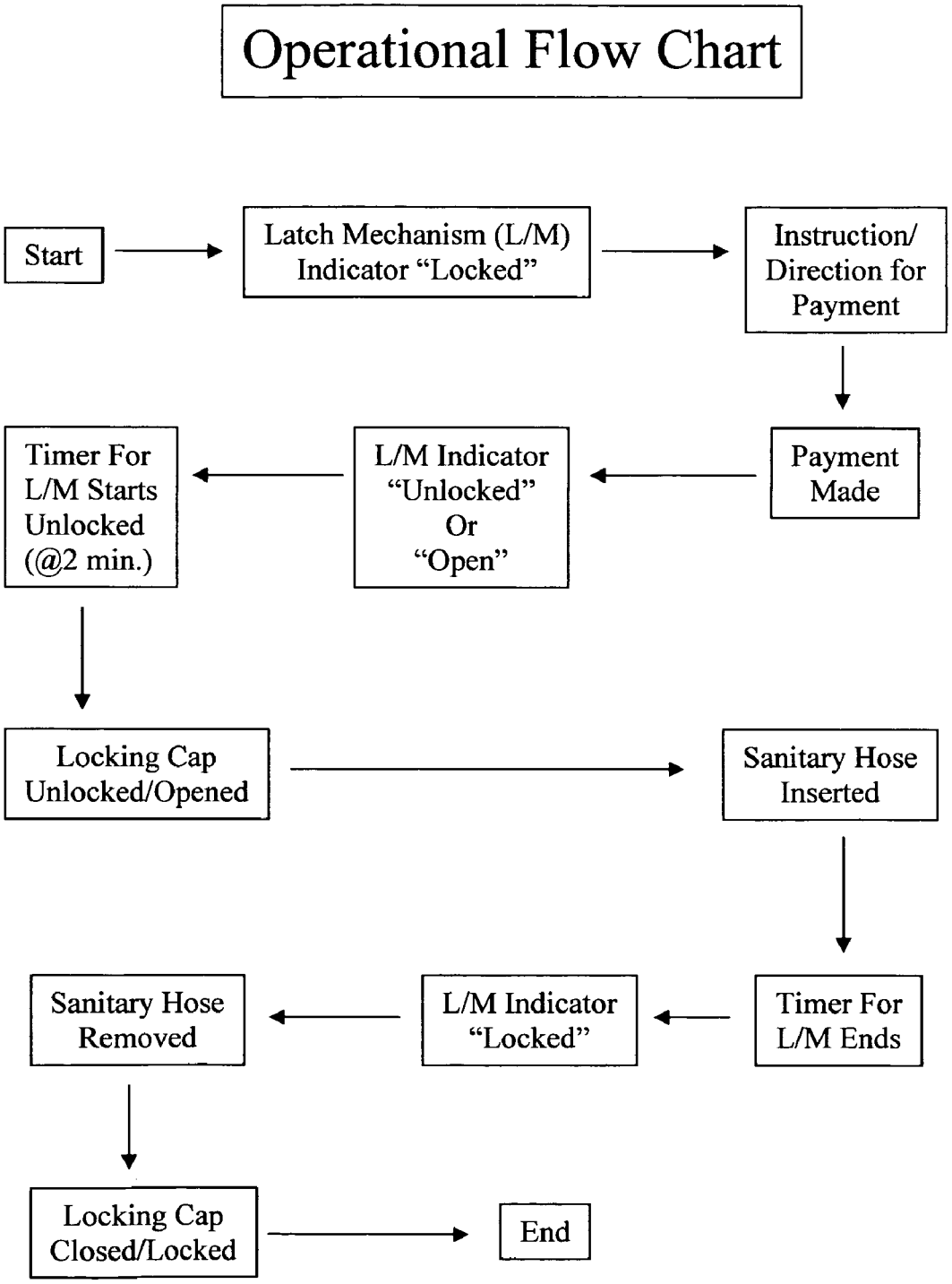
FIG. 1 is a block diagram of the control system for operation of the self service automated dump station.

In FIG. 1 a block diagram illustrates the Operational Flow Chart used for the operation of the self service automated dump station. In following the flow chart, the operation of the automated dump station can be explained. Prior to starting the operation of the automated dump station, the RV operator will need to position the vehicle or trailer next to a dump station 40, see FIG. 2, and in close enough proximity so the operator is able to run a sewer or sanitary hose from the RV's holding tanks to a dump station's drain line 41. A drain line 41 is the surface or above ground inlet for a waste tank or a connection to a sewer line located below the dump station.

The RV holding tanks typically consists of two types of holding tanks; a grey water tank and a black water tank. The grey water tank is for waste and water from kitchen and bathroom sinks and bathroom shower drain water. The black water tank is for the toilet waste. Typically, the RV is equipped with an extendable sanitary hose that is connected to either the gray or dark tank or a common drain line. When the operator is sufficiently close enough to run the sanitary hose to the dump station drain line, the operator will position the sanitary hose into the drain line 41 of the dump station 40.

The present invention eliminates the need for the RV operator to interface with an attendant or clerk to transfer the waste from the holding tanks to the dump station. The RV operator is able to use the automated dump station at any time for a fee. It is not uncommon for dump stations to be locked or closed down if the associated business is closed. With an automated system, the dump station can be open 24 hours a day every day of the year.

When the RV operator has properly positioned the RV and the sanitary hose is ready to be inserted into the dump station drain line 41, the RV operator engages with a control panel 50 to start the process of transferring the waste. In one embodiment the control panel could have the following items: lights or indicators 52 for the various locking or latching mechanisms; instructions 51 to operate the automated dump station; and switches, buttons or keypads 53 to make a payments for using the automated dump station. In one embodiment, the control panel has an indicator light or switch position for a latch 31 in a latching mechanism 30, FIG. 3; a slot or slots for depositing cash or coins for using the dump station; and a means for making a payment by a credit or debit card. Another embodiment uses a liquid crystal display screen for making payments and operating the automated dump station. The liquid crystal display system could be connected to a microprocessor by pressure switches located under the display for facilitating the interface between the operator and the bank or monetary system to be accessed.

The microprocessor would then be able to interface with either the internet or a phone line for recording the appropriate payment. The present invention makes no claim on the operation of a touch screen LCD and microprocessor and the operations that are programmed into the microprocessor or made part of the microprocessor. There are many mechanical or electrical means for recording a payment to activate Other means for electronically activating the latching mechanism 30 are available to be employed and the description of the present invention is not meant to limit the claims associated with operation of the automated dump station.

Figure 2:
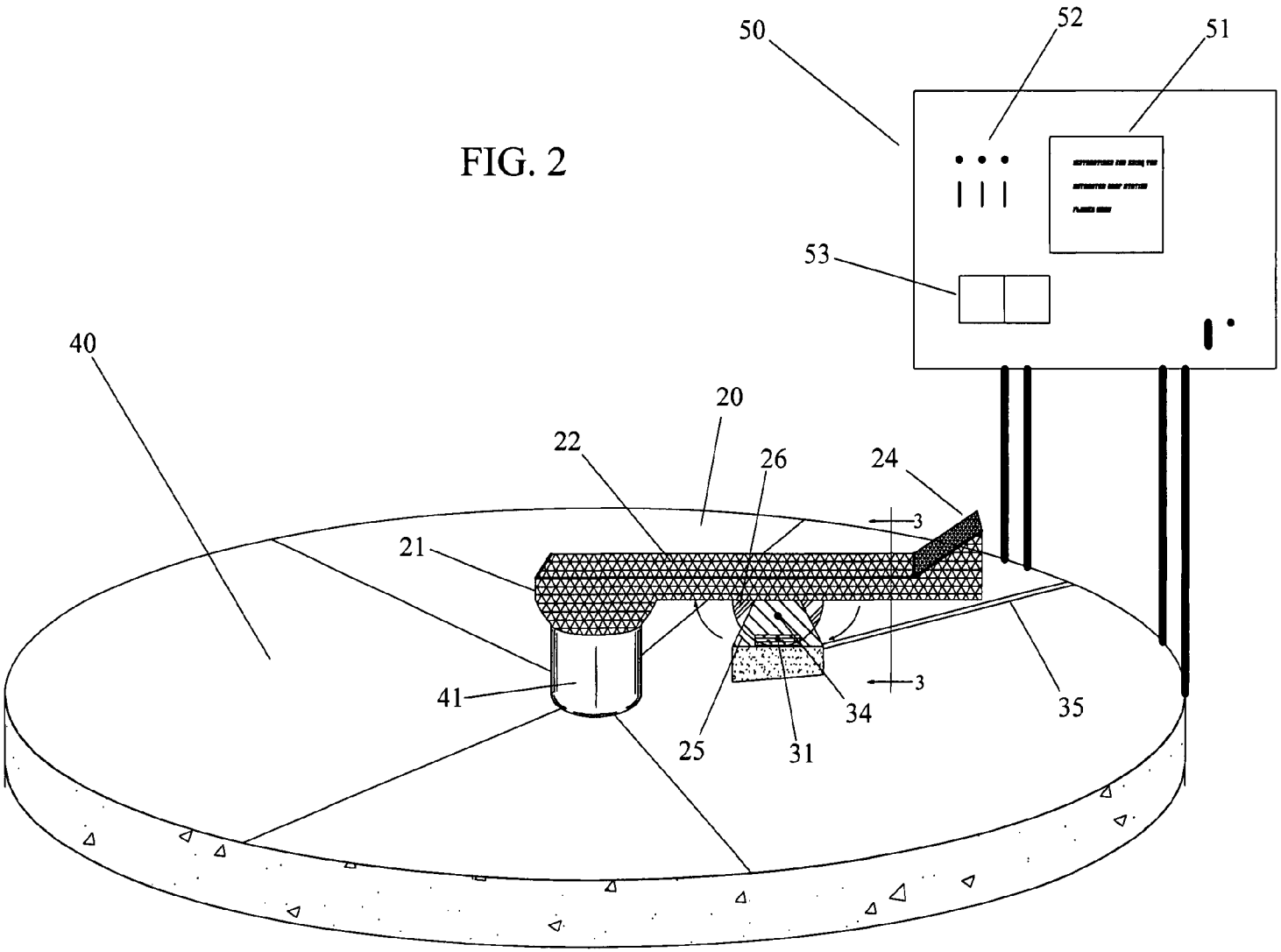
FIG. 2 is a side view of the automated dump station showing the dump station with a drain line, a lockable cap, lever, fulcrum, pivoting arm, remote foot actuator, and control panel.
Figure 3:
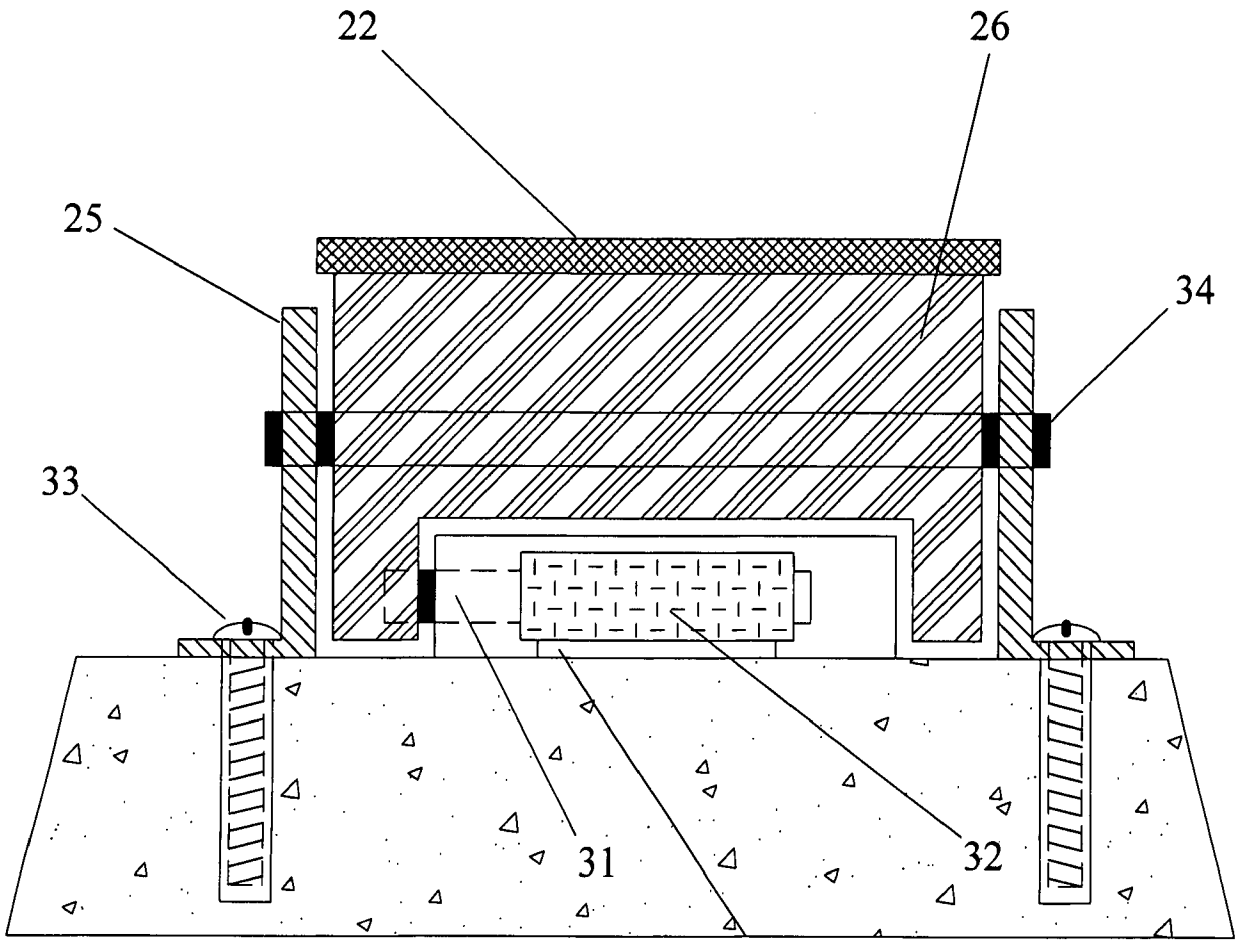
FIG. 3 is a partial end view of the lever, pivoting arm, pivoting pin, fulcrum, and latching mechanism with the latch in the locked position.

Prior to making a payment, an indicator light or switch could be used to show the latch 31 in the latching mechanism 30 is in the "locked" position, see FIG. 3. When the latch 31 is in the locked position, a locking cap 21 is locked into place over the drain line 41 of the dump station, see FIG. 2. After the payment has been made or registered, an indicator light or switch will display the latching mechanism 30 in the "unlocked" state. See FIG. 4. The RV operator is then able to lift the locking cap 21 situated over the drain line 41 of the dump station 40 and inserts the sanitary hose into the drain line. Once the sanitary hose is in place, the RV operator then transfers the waste into the dump station drain line by a pump, a pressurized blow or gravity.

The present invention could also be configured such that the locking cap 21 automatically is lifted off the drain line of the dump station once the RV operator has registered a payment. In the present invention, the RV operator causes the locking cap 21 to be lifted off the drain line by use of a remote actuator or remote foot actuator 24.

The instructions on the control panel 50 will inform the RV operator that the once the payment has been made, the latching mechanism 30 will remain "unlocked" for a set period of time. In one embodiment of the invention, the latching mechanism 30 is left in the unlocked position for approximately two minutes. The RV operator upon removing the locking cap 21 places the sanitary hose into the drain line preventing the locking cap 21 from being placed in the closed position over the drain line. The RV operator is provided approximately two minutes after making the payment to remove or lift the locking cap 21 from the drain line and inserting the sanitary hose. After the twenty seconds is over, an electronic solenoid 32 that has repositioned the latch 31 in the latching mechanism 30 to the unlocked position is depowered and the latch 31 returns to the locked position. While the operation of transferring the waste can take some time, the latching mechanism 30 is re-positioned such that when the locking cap 21 is replaced over the drain line the locking cap 21 will be locked shut over the drain line.

When the transfer of waste is completed, the sanitary hose is removed from the drain line and the locking cap 21 is replaced over the drain line with the latching mechanism 30 locking the locking cap 21 in a closed position. On the control panel, indicators can show the latching mechanism 30 to be in the locked position and the locking cap 21 in the closed position.

Presently at most dump stations, a cap or cover is typically placed over the drain line. The cap or cover is generally hinged in place and can pivot off the drain line exposing the drain line for the insertion of the sanitary hose. At some dump stations, the cap or cover may not be hinged but able to be removed prior to dumping waste. When the dumping operation is completed the cap or cover is replaced. On some dump stations, a lock is placed on the cap or cover when the dump station is not in use or the dump station is closed—for example, when an associated business, like a gas station, is closed. In the present invention, the use of the dump station is not dependent upon an assistant or clerk to use the dump station. The dump station is able to be used at any time and without the need for an assistant or clerk.

In the present invention, the cap or cover is replaced by the locking cap 21 which is secured in place by the latching mechanism 30 in the closed position. See FIG. 2 and FIG. 3. The locking cap 21 and latching mechanism 30 can come in different forms or designs that replicate the same function as the figures depict. It is intended that the present invention not be limited by the design pictured or detailed in the figures.

Figure 4:
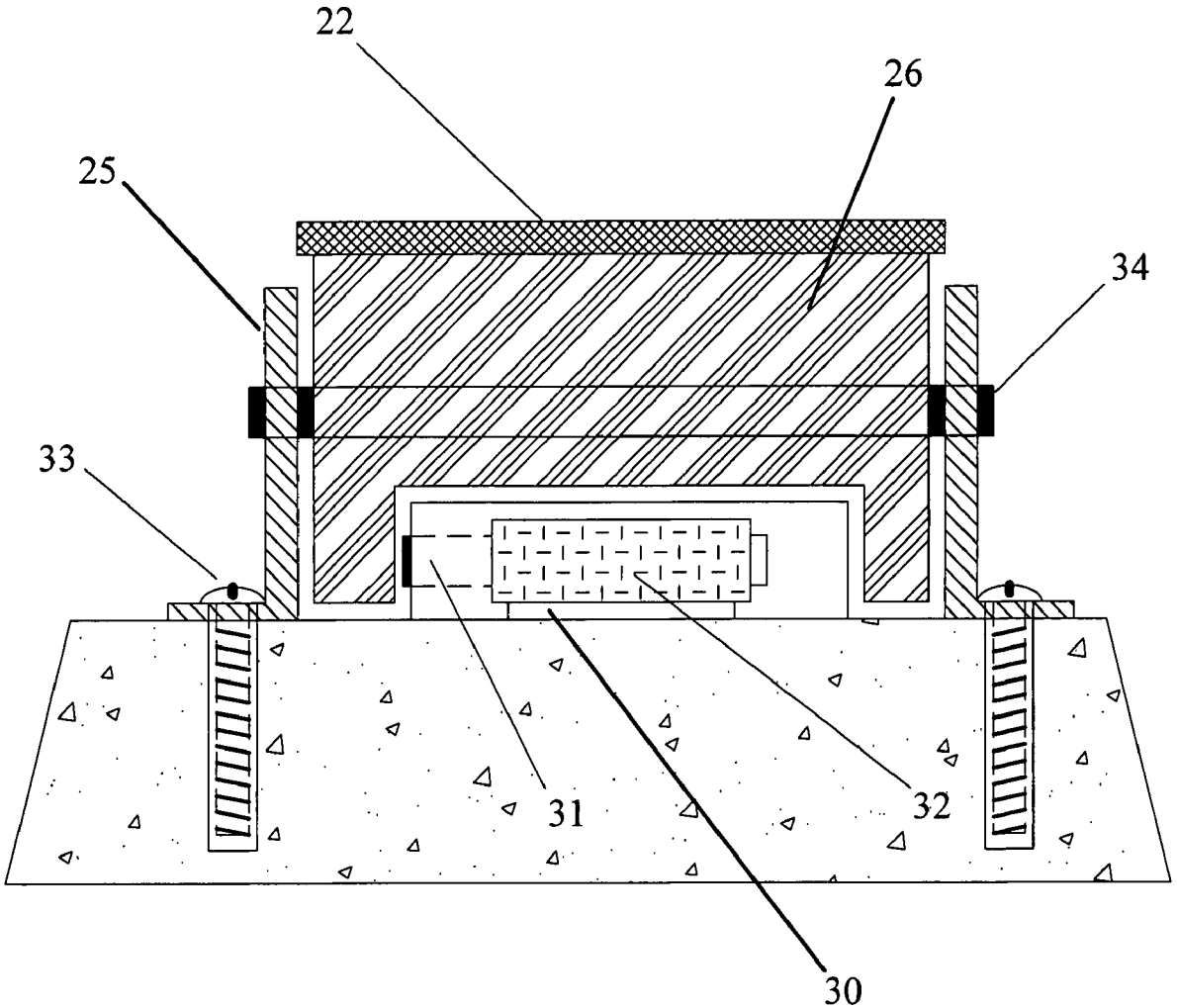
FIG. 4 is a partial end view of the lever, pivoting arm, pivoting pin, fulcrum, and latching mechanism with the latch in the unlocked position.

When the RV operator makes or registers a payment, a switch activates the latching mechanism 30 and the latch 31 is unlocked—see FIG. 4, the locking cap 21 is able to be lifted off the drain line. The means for activating the latching mechanism 30 in the present invention is by use of switch that allows electrical power to energize a solenoid 32 causing the latch 31 to reposition itself in the latching mechanism 30. When the solenoid 32 is not powered, the latch 31 is in the locked position and when the locking cap 21 is over the drain line, the latch 31 secures keeps the locking cap 21 securely over the drain line preventing use of the dump station until a payment has been registered.

Once the payment has been made and the latching mechanism 30 is unlocked and the locking cap 21 is lifted off the drain line by operating a remote foot actuator 24, see FIGS. 2 and 3. The RV operator places his or her foot on the foot actuator and the locking cap 21 is pivoted off the drain line exposing the drain line for the operator to insert the sanitary hose for dumping.

In one embodiment, see FIG. 2, the locking cap 21 and remote foot actuator 24 are deployed on a lever 22 type design with the locking cap 21 and remote foot actuator 24 being at opposite ends of the lever 22 with a fulcrum 25 placed between the locking cap 21 and the remote foot actuator 24, see FIGS. 2 and 3. The locking cap 21 and remote foot actuator 24 are weighted such that the locking cap 21 will return to a closed position—the closed position is the position of the locking cap 21 covering the drain line—when there is no external force supplied to the remote foot actuator 24. To open or lift the locking cap 21 from the drain line a force (or foot) is placed on the remote foot actuator 24 end of the lever 22 causing the locking cap 21 to lift off the drain line. This design is useful in that the operator does not have to use his or her hands to open or lift the locking cap 21—this minimizes the possibility of waste coming into contact with the operator—and allows the operator to use his or her hand for placing the sanitary hose into the exposed drain line.

In FIGS. 2, 3 and 4, the locking cap 21 and remote foot actuator 24 are pivotally attached to the fulcrum 25 allowing for the locking cap 21 to be raised and lowered over the drain line when the remote foot actuator 24 is stepped on by the RV operator. The fulcrum 25 is attached and secured next to the drain line by anchor bolts 33. The latching mechanism 30 is located below a pivoting support 26 which is attached to the fulcrum 25 by means of a pivoting pin 34. The latch 31, when the latching mechanism 30 is in the locked position, is positioned such that the lever 22 of the locking cap 21 and the remote foot actuator 24 are unable to move or pivot this is accomplished by the latch 31 extending into the body of the pivoting support 26 when the latching mechanism is in the locked position. This restriction of the pivoting motion of the locking cap 21 and remote foot actuator 24 keeps the locking cap 21 in place over the drain line of the dump station. When the latch 31 of the latching mechanism 30 is repositioned into an "unlocked" position—see FIG. 4, for example when the RV operator has registered a payment, the locking cap 21 is free to pivot off the drain line once the operator has placed his or her foot on the remote foot actuator 24.

When the RV operator makes or registers a payment to use the dump station, a signal is generated and sent to a switch allowing the solenoid 32 to be powered for a set period of time—in the preferred embodiment, two minutes. When powered, the solenoid 32 places the latch 31 in an "unlocked" position—FIG. 4. This allows the RV operator to step on the remote foot actuator 24 raising the locking cap 21 off the drain line. The RV operator has two minutes from the time the operator has made the payment to lift the locking cap 21 and insert the sanitary hose into the drain line of the dump station. The solenoid 32 is powered for two minutes to allow the RV operator to open the locking cap 21 and insert the sanitary hose. The solenoid 32 is de-powered after the two minutes to reposition the latch 31 in the locked position.

Like many latches, the latch 31 is configured such that the latch is able to slide in and out of the solenoid when the solenoid is "depowered—allowing for the pivoting arm 26 to rotate back in place (with the locking cap over the drain line) once the RV operator is completed transferring waste and has removed the sanitary hose. The pivoting arm 26 has a recess, at the point the locking cap 21 is closed over the drain line 41, in which the latch 31 is able to be inserted. With the latch 31 in the recess of the pivoting arm 26, the lever 22 is unable to rotate and the locking cap 21 is secured over the drain line 41 until the solenoid 32 is energized and the latch 31 is repositioned to the unlock position.

Once the transfer has been completed, the RV operator removes the sanitary hose; the locking cap 21 is lowered into place as the RV operator steps off the remote foot actuator 24. When the locking cap 21 is lowered over the drain line the latch 31 catches in the recess of the pivoting arm 26 securing the locking cap 21 into place. The latch 31 operates in a manner similar to other types of latches that are able to slide in due to the design but once the locking cap 21 is lowered the latch 31 is secured in place preventing the locking cap 21 from being lifted until a payment is registered and the solenoid 32 is powered—repositioning the latch 31.

In FIG. 2, power lines 35 are shown running from the control panel toward the latching mechanism. The power lines provide the electricity that powers the solenoid to reposition the latch when the RV operator has registered a payment. The figures depict a solenoid 32 that is powered by an electrical power source—other means for repositioning the latch 31 are possible, including mechanical linkages, or hydraulics and the description provided is not meant to limit the means by which the latch 31 is repositioned once a payment has been registered.

In other embodiments of the invention, the automated dump station has automated sensors that are able to detect with the dump station waste tank is full or unable to collect additional waste. A signal or switch would indicate to a person that attempts to use the automated dump station that the dump station is unable to collect additional waste. A remote sensor could automatically transmit a signal informing the dump station operator or owner that the dump station is unable to collect additional waste. By not allowing additional waste to be collected when the waste tank is full and notifying the dump station operator of the situation minimizes the amount of time in which the dump station is not operable and prevents the spillage of waste from the dump station when too much waste is transferred into the dump station waste tank.

I claim:

1. An automated dump station comprising:

a dump station with a drain line that has an opening that defines an inlet into a receptacle for receiving waste from a holding tank, said waste transferred from said holding tank to said dump station through a drain hose, a unitary lever arm mounted directly to said receptacle, said unitary lever arm having a locking cap positioned on one end thereof and the opposite end of said unitary lever arm defining an actuator pedal, said unitary lever arm selectively movable to move the locking cap from a locking cap first position in which the locking cap is positioned directly over and not spaced apart from the inlet to thereby cover and thereby occlude said opening to thereby prevent said drain hose from being inserted into said opening, and a locking cap second position in which the locking cap is lifted off the inlet and spaced apart therefrom to allow said drain hose to be inserted into said opening so that said drain hose is fluidly connected to the dump station;

a latching mechanism associated with the unitary lever arm and selectively movable from a locked position in which the locking cap is locked in the locking cap first position and an unlocked position in which the locking cap may be moved to the locking cap second position;

a control assembly with means to accept and register a monetary payment, whereby a signal generated by said payment triggers the repositioning of the latching mechanism from the locked position to the unlocked position.

2. The automated dump station of claim 1 wherein the unitary lever arm is pivotally connected to a fulcrum at an intermediate position between said locking cap and said actuator pedal, wherein the locking cap is moved from the locking cap first position to the locking cap second position when the latching mechanism is in the unlocked position and an operator steps on the actuator pedal.

3. The automated dump station of claim 2 wherein said unitary lever arm is pivotally connected to the fulcrum such that said locking cap is normally in the locking cap first position and wherein the latching mechanism is located such that the latch may be secured into the pivoting arm when the locking cap is in the locking cap first position.

4. The automated dump station of claim 1 wherein an electric solenoid is used to reposition a latch of the latching mechanism from a locked position to an unlocked position when a payment is registered.

5. The automated dump station of claim 4 wherein the electric solenoid is powered for approximately two minutes to allow the locking cap to be raised and the sanitary hose to be inserted before the latching mechanism is repositioned to locked position.

6. The automated dump station of claim 1 wherein the locking cap is weighted such that said locking cap is normally in the locking cap first position.

7. The method of transferring waste from a recreational vehicle waste tank to a dump station waste receptacle comprising:

collecting waste in the recreational vehicle waste tank;

pivotally mounting a unitary lever arm directly to said dump station waste receptacle, said unitary lever arm having a locking cap positioned on one end thereof and the opposite end of said unitary lever arm defining an actuator pedal, said unitary lever arm selectively operable to move the locking cap from a locking cap first position in which the locking cap is positioned directly over and not spaced apart from an inlet opening into the dump station waste receptacle to thereby cover and occlude said inlet opening to thereby prevent a sanitary hose from being inserted into said inlet opening, and a locking cap section position in which the locking cap is lifted off the inlet opening and spaced apart therefrom to allow said sanitary hose to be inserted into said inlet opening so that said sanitary hose is fluidly connected to the dump station waste receptacle;

positioning the recreational vehicle in proximity to the dump station waste receptacle such that said sanitary hose is able to extend from the recreational vehicle waste tank to the inlet opening into the dump station waste receptacle without removal of said waste tank from said recreational vehicle;

registering a payment on a control panel operating in conjunction with the dump station;

generating a signal upon receipt of the payment;

in response to the signal, activating a solenoid to thereby reposition a latch from a locked position to an unlocked position and to thereby unlock the locking cap;

with the latch in the unlocked position, repositioning the locking cap from its locking cap first position to the locking cap second position in which the locking cap is spaced apart from said inlet opening to thereby expose the inlet opening into the dump station waste receptacle so that said sanitary hose may be inserted into said inlet opening;

inserting one end of the sanitary hose into the exposed inlet opening into the dump station waste receptacle with the other end connected to the recreational vehicle waste tank without removal of said waste tank from said recreational vehicle;

transferring the waste from the recreational vehicle waste tank to the dump station waste receptacle via the sanitary hose;

removing the sanitary hose from the inlet opening into the dump station waste receptacle;

repositioning the locking cap from the locking cap second position to the locking cap first position so that said locking cap is again positioned directly over the inlet opening into the dump station receptacle so that the locking cap covers said inlet opening and thereby prevents access to the inlet opening into the dump station waste receptacle;

repositioning the latch to a locked position to lock the locking cap in the locking cap first position; and securing the locking cap in the locking cap first position until a new payment is registered.

* * * * *